US007779486B2

(12) United States Patent
Tomlinson et al.

(10) Patent No.: US 7,779,486 B2
(45) Date of Patent: Aug. 24, 2010

(54) GARMENT WITH UNDERARM EXTERNALLY ACCESSIBLE BREAST POCKETS AND METHOD OF USE

(75) Inventors: Jodi Tomlinson, Ponce Inlet, FL (US); Kevin P. Cutlip, Ponce Inlet, FL (US)

(73) Assignee: GX, Inc., Daytona Beach Shores, FL (US)

( * ) Notice: Subject to any disclaimer, the term of this patent is extended or adjusted under 35 U.S.C. 154(b) by 273 days.

(21) Appl. No.: 12/006,951

(22) Filed: Jan. 8, 2008

(65) Prior Publication Data

US 2009/0172860 A1 Jul. 9, 2009

(51) Int. Cl.
*A41B 1/00* (2006.01)
*A41D 13/00* (2006.01)

(52) U.S. Cl. ..... 2/94; 3/85; 3/108

(58) Field of Classification Search ..... 2/85, 2/93, 94, 108, 125, 126, 96, 90, 115, 114, 2/113, 105, 106
See application file for complete search history.

(56) References Cited

U.S. PATENT DOCUMENTS

| | | | | |
|---|---|---|---|---|
| 1,605,817 | A * | 11/1926 | Dozer | 2/69.5 |
| 4,123,804 | A | 11/1978 | Michael et al. | |
| 4,882,786 | A * | 11/1989 | Gross | 2/94 |
| 4,944,041 | A | 7/1990 | Buenos et al. | |
| 5,072,456 | A | 12/1991 | Elin | |
| 5,953,759 | A | 9/1999 | Bozzini | |
| 6,148,443 | A | 11/2000 | Maastricht | |
| 6,314,580 | B1 * | 11/2001 | Greenberg et al. | 2/108 |
| 2007/0000030 | A1 | 1/2007 | Toomey et al. | |
| 2007/0083979 | A1 | 4/2007 | Daniels | |

OTHER PUBLICATIONS

U.S. Appl. No. 12/231,036, filed Aug. 29, 2008 Tomlinson et al. (CIP of this app.).

PCT application based on the app., PCT/US2008/004314, Apr. 3, 2008.

International Search Report and Written Opinion pertaining to PCT application, with non-US references available to Applicant (previously submitted), PCT/US2008/004314, Oct. 24, 2008.

(Continued)

*Primary Examiner*—Gloria Hale
(74) *Attorney, Agent, or Firm*—Paul S. Rooy, PA

(57) ABSTRACT

A garment with underarm externally accessible breast pockets and method of use. An upper body garment is disclosed having garment sleeves attached to a garment trunk, and a pocket mouth disposed under each garment sleeve. A pocket is attached to the garment trunk at each pocket mouth. A passenger positioned behind a driver wearing the upper body garment may insert hands and arms through the pocket mouths and into the pockets for warmth, security, and or intimacy enhancement. The pockets may terminate in conventional pocket shape, mitten shape, or glove shape, which latter two embodiments permit gripping of thumb lobes, major lobes, and/or finger lobes between the passenger thumbs and fingers, thus increasing passenger security. In another embodiment, non-slip material may be attached inside the pockets for increased passenger security. A method of use is disclosed wherein a passenger seated behind a driver inserts hands and arms into the pockets.

26 Claims, 4 Drawing Sheets

OTHER PUBLICATIONS

Two Notification of the Recording of a Change pertaining to PCT application (previously submitted), PCT/US2008/004314, Sep. 26, 2008.

European Patent App. based on PCT/US2008/004314 (copy att'd.), EPO08169668.4, Nov. 21, 2008.

Extended European Search Report dtd. Mar. 3, 2009 with BE 1015803 (copies att'd), EPO08169668.4-1256, Nov. 21, 2008.

Canadian patent application based on this application, 2,646,859, Dec. 17, 2008.

* cited by examiner

GARMENT WITH UNDERARM EXTERNALLY ACCESSIBLE BREAST POCKETS AND METHOD OF USE

BACKGROUND OF THE INVENTION

1. Field of the Invention

This invention relates to upper garments, and in particular to a garment with underarm externally accessible breast pockets and method of use.

2. Background of the Invention

An on-going challenge inherent in tandem riding in vehicles such as motorcycles, motor scooters, motorized tricycles, jet skis, sleds, etc., is keeping the rear passenger securely in the rear seat. The vehicle driver has the handlebars to hold on to; the rear passenger frequently has only the driver.

In addition, riding these types of vehicles can be a cold and breezy endeavor. Thus, it would be desirable to provide the vehicle passenger a warm place to put his or her hands while holding on to the driver for support.

Finally, holding on to a vehicle driver garbed in a leather jacket can be a rather cold and impersonal experience, due to the thickness of the jacket or other upper body garment. Therefore, it would be desirable to provide an upper body garment which provides interior pockets accessible from the outside, to act as in intimacy enhancer between the driver and the rear passenger.

Existing Designs

Numerous designs for rear vehicle racks (such as motorcycle luggage racks) are available on the market. The rear passenger may grasp these for support, but this procedure typically doesn't work as well as simply holding on to the driver. In addition, the racks currently available do not keep the rear passenger's hands warm, nor do they enhance the intimacy between the driver and the passenger.

Thus, it would be desirable to provide an upper body garment with underarm externally accessible breast pockets and method of use, which securely supports the rear passenger, warms the rear passenger's hands, and enhances intimacy between the vehicle driver and the passenger.

SUMMARY OF THE INVENTION

Accordingly, it is an object of the present invention to provide a garment with underarm externally accessible breast pockets and method of use which helps keep a passenger securely seated on the vehicle rear seat. As used in this disclosure, the term vehicle is intended to refer to any vehicle wherein at least one passenger is seated behind a driver, including but not limited to motorcycles, scooters, motorized tricycles, jet skis, sleds, etc. Design features allowing this object to be accomplished include an upper body garment worn by the vehicle driver which has externally accessible breast pockets. An advantage associated with the accomplishment of this object is increased vehicle passenger security.

It is another object of the present invention to provide a garment with underarm externally accessible breast pockets and method of use which helps keep the rear vehicle passenger's hands and arms warm. Design features allowing this object to be accomplished include an upper body garment worn by the vehicle driver which has externally accessible breast pockets. A benefit associated with the accomplishment of this object is increased passenger comfort achieved by inserting the hands and arms of the passenger into the pockets within an upper body garment, and sharing the body warmth of the driver.

It is still another object of the present invention to provide a garment with underarm externally accessible breast pockets and method of use which enhances intimacy between a vehicle driver and a vehicle passenger. Design features allowing this object to be accomplished include an upper body garment worn by the vehicle driver which has externally accessible breast pockets, and which permit the passenger to introduce his or her hands through the outer fabric of an upper body garment worn by the driver. An advantages associated with the accomplishment of this object is increased closeness between the vehicle driver and the vehicle passenger.

It is yet another object of this invention to provide a garment with underarm externally accessible breast pockets and method of use which is inexpensive to produce. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1 and 2. Sheet two contains FIGS. 3 and 4. Sheet three contains FIGS. 5 and 6. Sheet four contains FIGS. 7 and 8.

DETAILED DESCRIPTION OF THE PREFERRED EMBODIMENT

Figure 3:
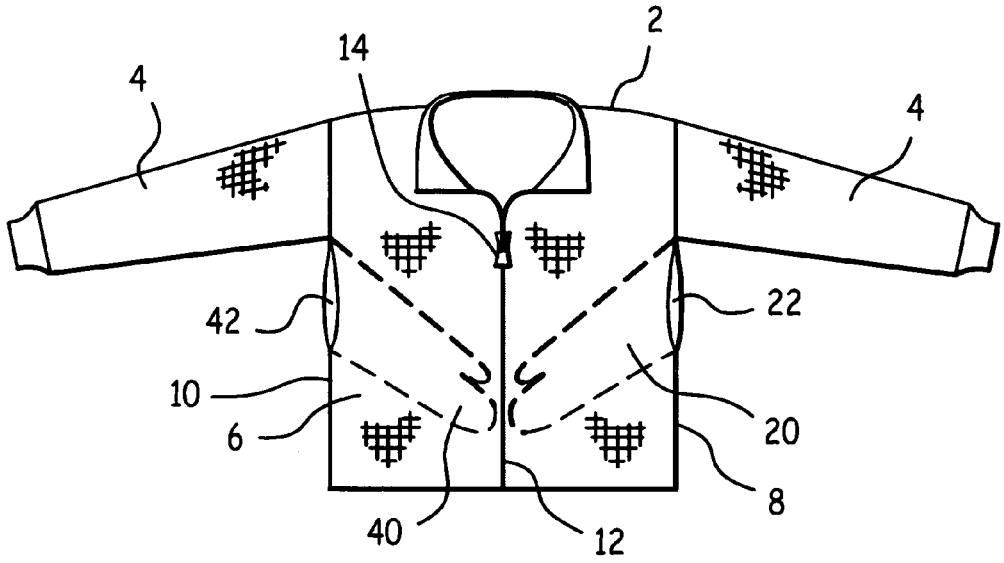
FIG. 3 is a front view of a garment with underarm externally accessible breast pockets, with the pockets depicted in dashed lines.

Referring now to FIG. 3 we observe a front view of upper body garment 2 having sleeves 4, garment trunk 6, garment front opening 12, and garment zipper 14, which serves to close garment front opening 12 in conventional fashion. The side edges of garment trunk 6 are garment left side 8 which extends downwardly from the intersection of left garment sleeve 4 with garment trunk 6, and garment right side 10 which extends downwardly from the intersection of right garment sleeve 4 with garment trunk 6.

Figure 4:
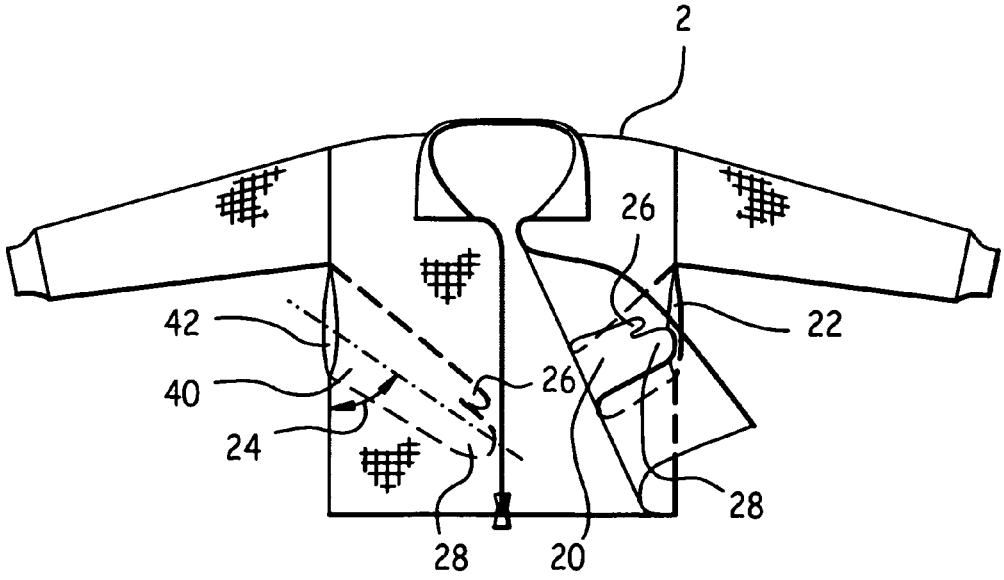
FIG. 4 is a front view of a garment with underarm externally accessible breast pockets, with its left side open.

FIG. 4 is a front view of upper body garment 2 with the left side of garment trunk 6 open, showing the internal placement of left pocket 20.

Garment 2 incorporates left pocket 20 which communicates with an exterior of upper body garment 2 through left pocket mouth 22, and right pocket 40 which communicates with an exterior of upper body garment 2 through right pocket mouth 42. Left pocket 20 and right pocket 40 are depicted in dashed lines.

Left pocket mouth 22 is disposed along garment left side 8, extending downwardly directly below the intersection of left garment sleeve 4 with garment trunk 6. Right pocket mouth 42 is disposed along garment right side 10, extending downwardly from the intersection of right garment sleeve 4 with garment trunk 6.

Left pocket mouth 22 and left pocket 20 are sized to admit the hand and arm of a passenger, so that a passenger is able to insert his or her arm through left pocket mouth 22 and into left pocket 20 of an upper body garment 2 worn by the driver, for security, warmth, and/or intimacy enhancement. Similarly, right pocket mouth 42 and right pocket 40 are sized to admit the hand and arm of a passenger, so that a passenger is able to insert his or her arm through right pocket mouth 42 and into right pocket 40 of an upper body garment 2 worn by the driver, for security, warmth, and/or intimacy enhancement.

While in the preferred embodiment the end of pockets 20, 40 extended substantially to garment front opening 12, it is intended to fall within the scope of this disclosure that pockets 20, 40 may be any appropriate length.

Figure 1:
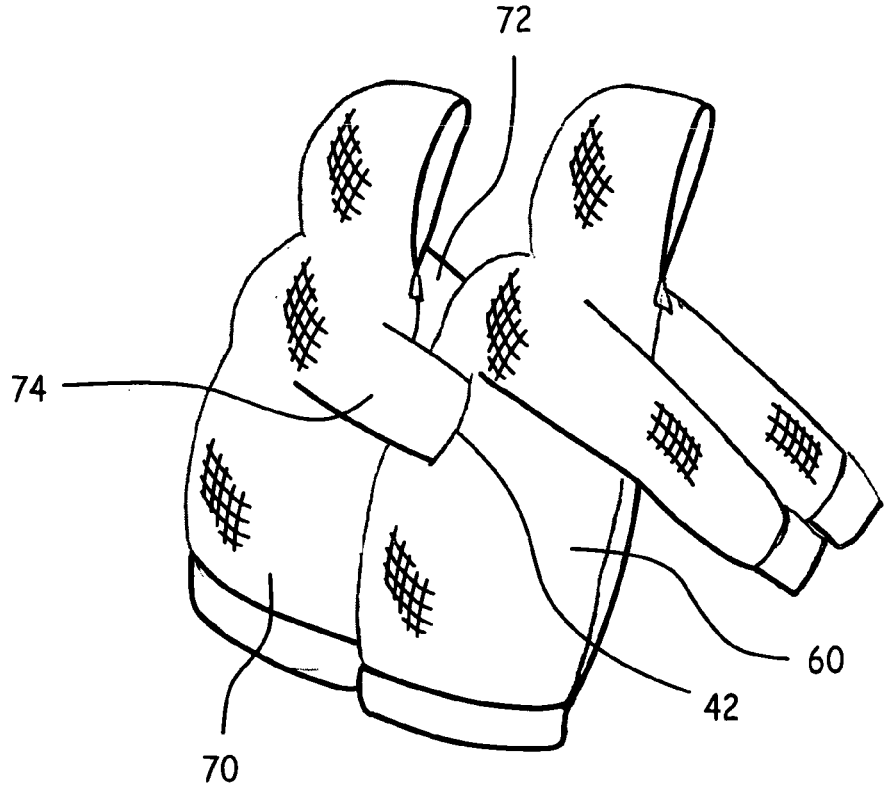
FIG. 1 is a side view of a driver and a passenger; the driver is wearing a garment with underarm externally accessible breast pockets and the passenger has his or her arms inserted into the underarm pockets for security, warmth, and/or intimacy enhancement.

FIG. 1 is a side view of a passenger 70 riding on a vehicle behind a driver 60. The driver is wearing a garment with underarm externally accessible breast pockets, which comprises upper body garment 2 having left pocket 20 which communicates with the exterior of upper body garment 2 through left pocket mouth 22, and right pocket 40 which communicates with the exterior of upper body garment 2 through right pocket mouth 42.

Passenger 70 has passenger right arm 74 inserted through right pocket mouth 42 and into right pocket 40, and passenger left arm 72 inserted through left pocket mouth 22 and into left pocket 20. Thus, passenger 70 has both passenger arms 72, 74 inserted into corresponding pockets 20, 40 in upper body garment 2 worn by driver 60, for security, warmth, and/or intimacy enhancement.

Figure 2:
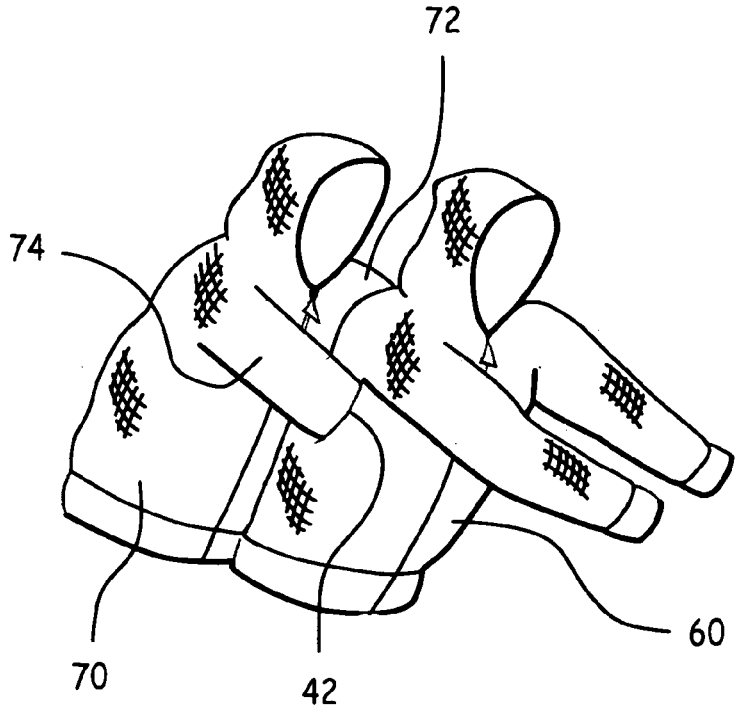
FIG. 2 is a front quarter isometric view of a driver and a passenger; the driver is wearing a garment with underarm externally accessible breast pockets and the passenger has his or her arms inserted into the underarm pockets for security, warmth, and/or intimacy enhancement.

FIG. 2 is a front quarter isometric view of a driver 60 and a passenger 70. The driver is wearing upper body garment 2 having left pocket 20 which communicates with the exterior of upper body garment 2 through left pocket mouth 22, and right pocket 40 which communicates with the exterior of upper body garment 2 through right pocket mouth 42. Passenger 70 has passenger right arm 74 inserted through right pocket mouth 42 and into right pocket 40, and passenger left arm 74 inserted through left pocket mouth 22 and into left pocket 20. Thus, as depicted in FIG. 2 passenger 70 has both passenger arms 72, 74 inserted into corresponding pockets 20, 40 in upper body garment 2 worn by driver 60, for security, warmth, and/or intimacy enhancement.

In the embodiment garment with underarm externally accessible breast pockets depicted in FIGS. 3 and 4, left pocket 20 and right pocket 40 each terminate in a mitten shape having thumb lobe 26 and major lobe 28. Thumb lobe 26 is sized to admit a passenger 70 thumb; major lobe 28 is sized to admit passenger 70 fingers.

In the embodiment garment with underarm externally accessible breast pockets depicted in FIGS. 3 and 4, left pocket 20 and right pocket 40 extend downwardly from garment left side 8 and garment right side 10 respectively at a pocket angle 24 substantially equal to 40 degrees±20 degrees. Many vehicles feature elevated rear seats, so this pocket angle 24 was experimentally determined to be optimal for some such seating configurations. In addition, where a driver 60 is not (and/or does not wish to become) intimately familiar with a passenger 70, a pocket angle 24 substantially equal to 40 degrees±20 degrees avoids placing the hands of passenger 70 directly on the breasts of driver 60.

In the embodiment depicted in FIG. 4 pocket angle 24 is fixed, by adhering pockets 20, 40 to the inside of garment trunk 6, by stitching, adhesive, or any other appropriate adhesion means. It is intended to fall within the scope of this disclosure, however, that pockets 20, 40 may be attached to upper body garment 2 solely at their respective pocket mouths 22, 42, leaving the rest of pockets 20, 40 free-floating within upper body garment 2. In this embodiment, passenger 70 may place his or her arms within pockets 20, 40 at any angle comfortable to, or desired by, passenger 70 and/or driver 60.

Figure 5:
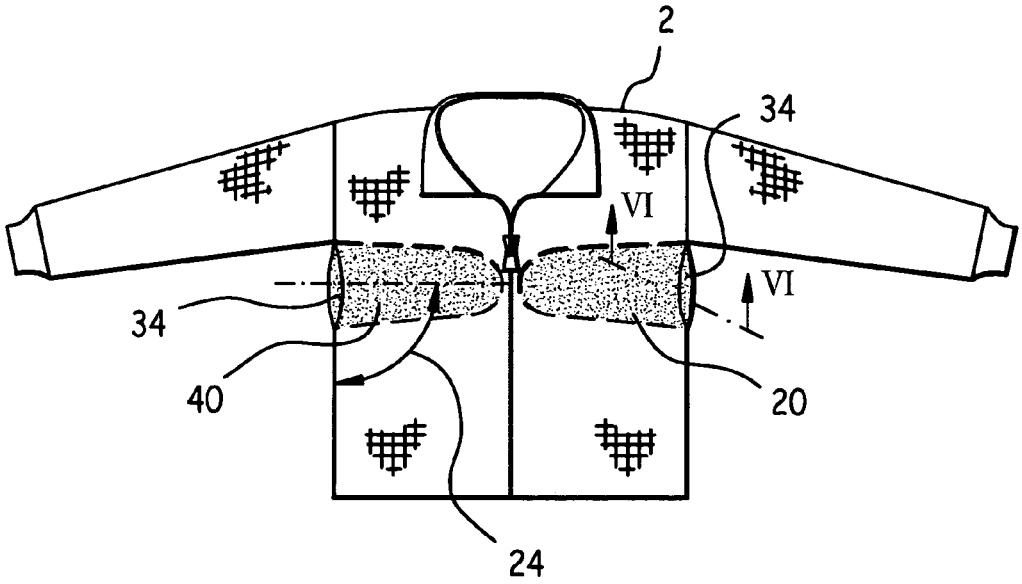
FIG. 5 is a front view of an alternate embodiment garment with underarm externally accessible breast pockets having a pocket angle of 90 degrees±20 degrees, and non-slip material lining the pocket floors.

FIG. 5 is a front view of an alternate embodiment garment with underarm externally accessible breast pockets having a pocket angle 24 of 90 degrees±20 degrees, and non-slip material 34 lining pocket floors 32.

Figure 6:
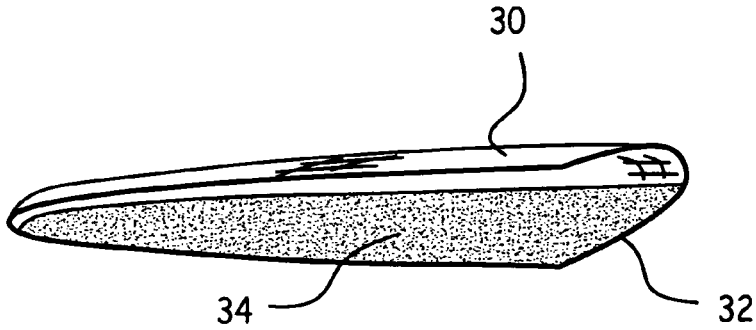
FIG. 6 is a side cross-sectional view of a pocket having non-slip material lining its pocket floor.

FIG. 6 is a side cross-sectional view of a pocket 20 or 40 having non-slip material 34 lining its pocket floor 32, taken at section VI-VI of FIG. 5. As may be observed in FIG. 6, pockets 20, 40 each comprise pocket roof 30 adjacent garment trunk 6, and pocket floor 32 opposite pocket roof 30. Non-slip material may be attached to floor 32 and/or pocket roof 30, to increase the security of the grip of the hands and arms of passenger 70 within pockets 20, 40. While non-slip material 34 may increase the security of the grip of passenger 70 on driver 60, it may also decrease the potential for intimacy enhancement by adding another layer of material between passenger 70 and driver 60.

In the preferred embodiment non-slip material 34 was rubberized fabric, rough-textured fabric, rubber coating, or any other appropriate non-slip material.

Figure 7:
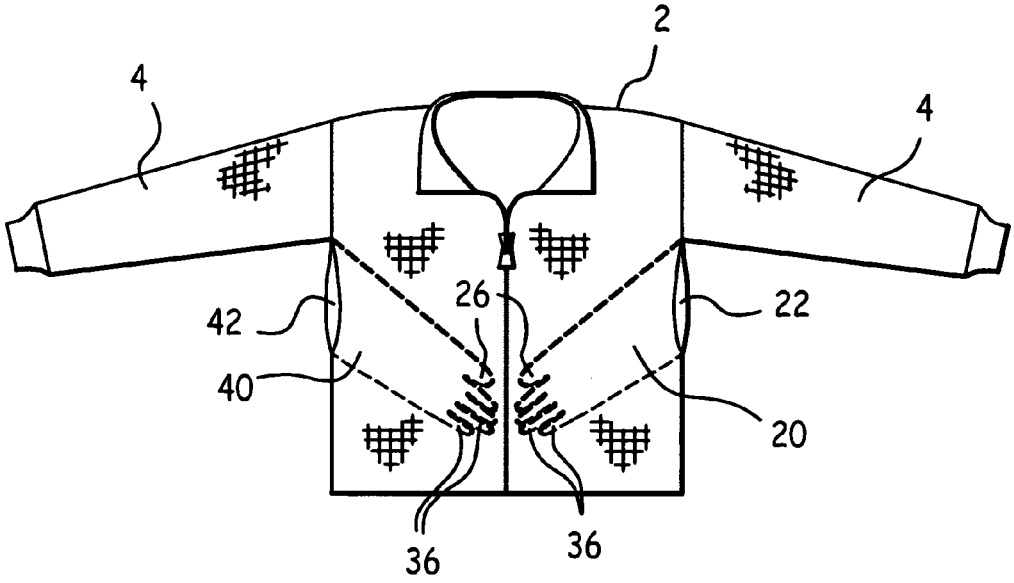
FIG. 7 is a is a front view of an alternate embodiment garment with underarm externally accessible breast pockets wherein the pockets terminate in a thumb lobe and a plurality of finger lobes.

FIG. 7 is a is a front view of an alternate embodiment garment with underarm externally accessible breast pockets wherein pockets 20, 40 terminate in a glove shape comprising thumb lobe 26 and a plurality of finger lobes 36. Typically the embodiment shown in FIG. 7 would comprise a single thumb lobe 26 and four finger lobes 36 per pocket 20, 40.

In the embodiment illustrated in FIGS. 5 and 6, pockets 20, 40 terminate in a simple closed end, as opposed to the mitten shape and glove shape pocket termination disclosed in FIGS. 3, 4 and 7 respectively. In the mitten shape termination of pockets 20, 40 illustrated in FIGS. 3 and 4, passenger 70 may increase the security of his or her grip within pockets 20, 40 by gripping thumb lobe 26 and major lobe 28 between the passenger's thumb and fingers. Similarly, in the glove shape termination of pockets 20, 40 illustrated in FIG. 7, passenger 70 may increase the security of his or her grip within pockets 20, 40 by gripping thumb lobe 26 and finger lobes 36 between the passenger's thumb and fingers.

Figure 8:
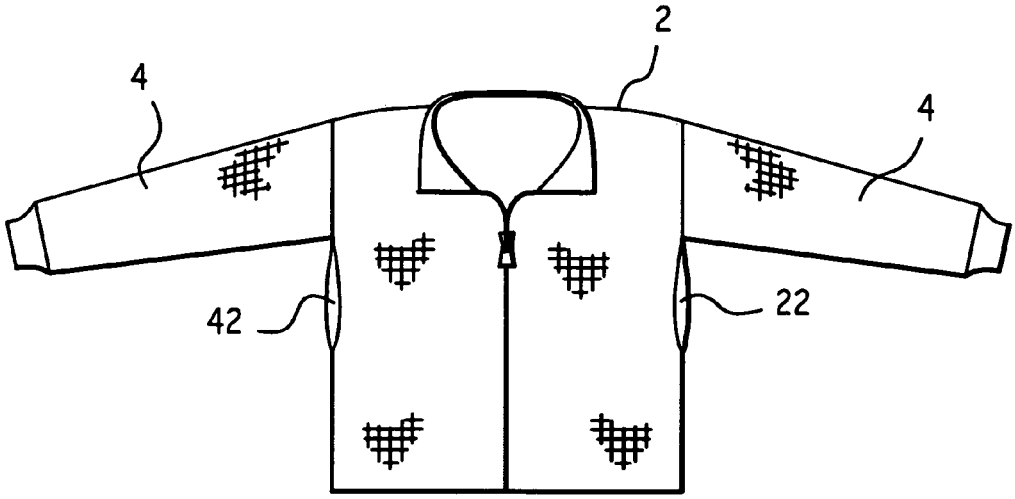
FIG. 8 is a is a front view of an alternate embodiment garment with underarm externally accessible breast pockets which comprises pocket mouths below the garment arms, and the garment itself serves as the pockets.

FIG. 8 is a front view of an alternate embodiment garment with underarm externally accessible breast pockets which comprises pocket mouths 22, 42 below the garment sleeves 4, and the garment itself serves as the pockets. In this embodiment passenger 70 introduces hands and arms through pocket mouths 22, 42, and grips driver 60 in conventional fashion, and upper body garment 2 plus the body warmth of the driver serve to keep the hands and arms of passenger 70 warm.

It should be noted that the different embodiments taught in this disclosure may achieve different purposes. Where a driver 60 is not (and/or does not wish to become) intimately familiar with a passenger 70, a pocket angle 24 substantially equal to 40 degrees±20 degrees avoids placing the hands of passenger 70 directly on the breasts of driver 60, as depicted in FIGS. 3 and 4.

Conversely, where a driver 60 is (or wishes to become) intimately familiar with a passenger 70, a pocket angle 24 substantially equal to 90 degrees±20 degrees places the hands of passenger 70 directly on the breasts of driver 60. In this embodiment, an offer of a motorcycle ride may actually constitute an invitation to greater intimacy, because as soon as passenger 70 is directed by driver 60 to place his or her hands and arms within pockets 20, 40 having a pocket angle 24 substantially equal to 90 degrees±20 degrees, passenger 70 finds his or her arms directly over the breasts of driver 60.

Similarly, where a driver 60 is (or wishes to become) intimately familiar with a passenger 70, the embodiment described above wherein pockets 20, 40 are attached to upper garment body 2 only at their respective mouths 22, 42, leaving the rest of pockets 20, 40 free-floating within upper body garment 2, may be appropriate. In this embodiment, passenger 70 may place his or her arms within pockets 20, 40 at any angle comfortable to, or desired by, passenger 70 and/or driver 60.

A similar effect is also achieved by the embodiment of FIG. 8, wherein upper body garment 2 itself is the pocket, and passenger 70 inserts his or her arms through left pocket mouth 22 and right pocket mouth 42 directly into the inside of upper body garment 2 worn by driver 60. In this embodiment, passenger 70 may place his or her arms at any angle comfortable to, or desired by, passenger 70 and/or driver 60, un-encumbered by pockets 20, 40. As in the 90±20 degrees pocket angle embodiment, in this embodiment, an offer of a motorcycle ride may actually constitute an invitation to greater intimacy, because as soon as passenger 70 is directed to place his or her hands and arms through pocket mouths 22, 42 passenger 70 finds his or her hands and arms free to position anywhere on the front torso of driver 60 comfortable to, or desired, by passenger 70 and/or driver 60. As in the free-floating pocket embodiment, the invitation to intimacy is not as explicit as in the 90±20 degrees pocket angle embodiment, where the hands of passenger 70 are channeled directly over the breasts of driver 60 by pockets 20, 40.

A trade-off for the increased intimacy enhancement potential of the free-floating pocket embodiment and the embodiment wherein upper body garment 2 itself is the pocket, may be decreased security of the grip of passenger 70 on driver 60. In addition, if pockets 20, 40 are lined with non-slip material, the tactile sensitivity between driver 60 and passenger 70 may be decreased, thus decreasing the potential for intimacy enhancement.

Accordingly, the instant method of use comprises the steps of:

A. Providing an upper body garment having a left garment sleeve and a right garment sleeve extending from a garment trunk, a garment left side extending downwardly from an intersection of said left garment sleeve with said garment trunk, a garment right side extending downwardly from an intersection of said right garment sleeve with said garment trunk, at least one pocket communicating with an exterior of said garment through a pocket mouth, said pocket mouth being disposed along one said garment side directly below one said garment sleeve;

B. A driver donning said upper body garment;

C. Positioning a passenger behind said driver; and

D. Said passenger inserting at least one passenger arm through said pocket mouth into said at least one pocket.

The instant method of use may comprise the further step of providing a mitten shape termination comprising a thumb lobe and a major lobe for each said at least one pocket, and said passenger gripping said thumb lobe and said major lobe between a passenger thumb and passenger fingers.

The instant method of use may comprise the further step of providing a glove shape termination comprising a thumb lobe and a plurality of finger lobes for each said at least one pocket, and said passenger gripping said thumb lobe and said finger lobes between a passenger thumb and passenger fingers.

The instant method of use may comprise the further step of providing non-slip material attached to an inside of each said at least one pocket, and said passenger gripping said non-slip material for increased passenger security.

The instant method of use may comprise the further steps of providing said at least one pocket at a pocket angle of substantially 90 degrees±20 degrees relative to said garment side where said pocket mouth is disposed, and channeling said passenger's hand through said pocket mouth, into said pocket, and directly over at least one breast of said driver.

The instant method of use may comprise the further steps of providing said at least one pocket at a pocket angle of substantially 40 degrees+20 degrees relative to said garment side where said pocket mouth is disposed, and channeling said passenger's hand through said pocket mouth, into said pocket, and away from a breast of said driver.

In the preferred embodiment, upper garment 2 and pockets 20, 40 were made of fabric, leather, synthetic, or any other appropriate material. Non-slip material 34 was rubberized fabric, rough-textured fabric, rubber coating, or any other appropriate non-slip material.

While a preferred embodiment of the invention has been illustrated herein, it is to be understood that changes and variations may be made by those skilled in the art without departing from the spirit of the appending claims.

DRAWING ITEM INDEX

2 upper body garment
4 garment arm
6 garment trunk
8 garment left side
10 garment right side
12 garment front opening
14 garment zipper
20 left pocket
22 left pocket mouth
24 pocket angle
26 thumb lobe
28 major lobe
30 pocket roof
32 pocket floor
34 non-slip material
36 finger lobe
40 right pocket
42 right pocket mouth
60 driver
70 passenger
72 passenger left arm
74 passenger right arm

We claim:

1. A garment with underarm externally accessible breast pockets for wearing by a driver of a tandem-seating vehicle comprising an upper body garment comprising a left garment sleeve, and a right garment sleeve depending from a garment trunk, a garment left side extending downwardly from an intersection of said garment left sleeve with said garment trunk, a garment right side extending downwardly from an intersection of said garment right sleeve with said garment trunk, at least one pocket mouth disposed directly below one said sleeve, a pocket disposed within said upper body garment corresponding to each said at least one pocket mouth, said at least one pocket mouth and each said pocket being sized to admit a hand and arm of a tandem passenger rider sitting behind said driver, and non-slip material adhered to an inside of each said pocket, whereby a security of grip of said tandem passenger may be increased.

2. The garment with underarm externally accessible breast pockets of claim 1 wherein each said pocket terminates in a mitten shape comprising a thumb lobe and a major lobe, said thumb lobe being sized to admit a passenger thumb, said major lobe being sized to admit passenger fingers.

3. The garment with underarm externally accessible breast pockets of claim 1 wherein each said pocket terminates in a glove shape comprising a thumb lobe and a plurality of finger lobes, said thumb lobe being sized to admit a passenger thumb, and each said finger lobe being sized to admit a passenger finger.

4. The garment with underarm externally accessible breast pockets of claim 1 wherein said upper body garment comprises a garment front opening in a front of said garment trunk, and each said pocket extends substantially from a respective said pocket mouth substantially to said garment front opening.

5. The garment with underarm externally accessible breast pockets of claim 1 wherein each said pocket is adhered to an inside of said upper body garment, and each said pocket is disposed at a pocket angle relative to a respective garment side of 40 degrees±20 degrees.

6. A garment with underarm externally accessible breast pockets for wearing by a driver of a tandem-seating vehicle comprising an upper body garment comprising a left garment sleeve and a right garment sleeve depending from a garment trunk, a garment left side extending downwardly from an intersection of said garment left sleeve with said garment trunk, a garment right side extending downwardly from an intersection of said garment right sleeve with said garment trunk, at least one pocket mouth disposed directly below one said sleeve, a pocket disposed within said upper body garment corresponding to each said at least one pocket mouth, said at least one pocket mouth and each said pocket being sized to admit a hand and arm of a tandem passenger rider sitting behind said driver, each said pocket being adhered to an inside of said upper body garment at a pocket angle relative to a respective garment side of 90 degrees±20 degrees, whereby said passenger's hand may be channeled by said pocket over at least one breast of said driver.

7. A garment with underarm externally accessible breast pockets for wearing by a driver of a tandem-seating vehicle comprising an upper body garment comprising a left garment sleeve and a right garment sleeve depending from a garment trunk, a garment left side extending downwardly from an intersection of said garment left sleeve with said garment trunk, a garment right side extending downwardly from an intersection of said garment right sleeve with said garment trunk, at least one pocket mouth disposed directly below one said sleeve, a pocket disposed within said upper body garment corresponding to each said at least one pocket mouth, said at least one pocket mouth and each said pocket being sized to admit a hand and arm of a tandem passenger rider sitting behind said driver, each said pocket being attached to said upper body garment only at a respective said pocket mouth, whereby the passenger's hands may move freely over a torso of said driver.

8. A method of wearing a garment with underarm externally accessible breast pockets that extend into the garment of a driver of a tandem-seating vehicle and wherein a tandem passenger rider sitting behind said driver places said passenger's hands therein comprising the steps of:

A. Providing an upper body garment having a left garment sleeve and a right garment sleeve extending from a garment trunk, a garment left side extending downwardly from an intersection of said left garment sleeve with said garment trunk, a garment right side extending downwardly from an intersection of said right garment sleeve with said garment trunk, at least one pocket communicating with an exterior of said garment through a pocket mouth, said pocket mouth being disposed along one said garment side directly below one said garment sleeve;

B. Said driver donning said upper body garment;

C. Positioning said passenger behind said driver; and

D. Said passenger inserting at least one passenger arm and hand through said pocket mouth into said at least one pocket.

9. The method of wearing a garment with underarm externally accessible breast pockets of claim 8 comprising the further steps of providing a mitten shape termination comprising a thumb lobe and a major lobe for each said at least one pocket, and said passenger gripping said thumb lobe and said major lobe between a passenger thumb and passenger fingers.

10. The method of wearing a garment with underarm externally accessible breast pockets of claim 8 comprising the further steps of providing a glove shape termination comprising a thumb lobe and a plurality of finger lobes for each said at least one pocket, and said passenger gripping said thumb lobe and said finger lobes between a passenger thumb and passenger fingers.

11. The method of wearing a garment with underarm externally accessible breast pockets of claim 8 comprising the further steps of providing non-slip material attached to an inside of each said at least one pocket, and said passenger gripping said non-slip material for increased passenger security.

12. The method of wearing a garment with underarm externally accessible breast pockets of claim 8 comprising the further steps of adhering said at least one pocket to an inside of said garment trunk at a pocket angle of substantially 90 degrees±20 degrees relative to a respective said garment side, and channeling said passenger's hand through said pocket mouth, into said pocket, and directly over at least one breast of said driver.

13. The method of wearing a garment with underarm externally accessible breast pockets of claim 8 comprising the further steps of adhering said at least one pocket to an inside of said garment trunk at a pocket angle of substantially 40 degrees±20 degrees relative to a respective said garment side, and channeling said passenger's hand through said pocket mouth, into said pocket, and away from a breast of said driver.

14. A garment with underarm externally accessible breast pockets for wearing by a driver of a tandem-seating vehicle comprising an upper body garment comprising a left garment sleeve and a right garment sleeve depending from a garment trunk, a garment left side extending downwardly from an intersection of said garment left sleeve with said garment trunk, a garment right side extending downwardly from an intersection of said garment right sleeve with said garment trunk, a left pocket mouth disposed directly below said left garment sleeve, a right pocket mouth disposed directly below said right garment sleeve, a left pocket disposed within said upper body garment communicating with an exterior of said upper body garment through said left pocket mouth, a right pocket disposed within said upper body garment communicating with an exterior of said upper body garment through said right pocket mouth, the pocket mouths and the pockets being sized to admit a hand and arm of a tandem passenger rider sitting behind said driver, said left pocket and said right pocket being adhered to an inside of said upper body garment, said left pocket being disposed at a pocket angle relative to said garment left side of 90 degrees±20 degrees, and said right pocket being disposed at a pocket angle relative to said garment right side of 90 degrees±20 degrees, whereby said tandem passenger's hands may be channeled by said pockets over said driver's breasts.

15. The garment with underarm externally accessible breast pockets of claim 14 wherein said left pocket and said right pocket are each adhered to an inside of said garment trunk, and each terminate in a mitten shape comprising a thumb lobe and a major lobe, said thumb lobe being sized to admit a passenger thumb, said major lobe being sized to admit passenger fingers, whereby said passenger may grip said thumb lobe and said major lobe between said passenger thumb and said passenger fingers for increased security.

16. The garment with underarm externally accessible breast pockets of claim 14 wherein said left pocket and said right pocket are each adhered to an inside of said garment trunk, and each terminate in a glove shape comprising a thumb lobe and a plurality of finger lobes, said thumb lobe being sized to admit a passenger thumb, and each said finger lobe being sized to admit a passenger finger, whereby said passenger may grip said thumb lobe and said finger lobes between said passenger thumb and said passenger fingers for increased security.

17. The garment with underarm externally accessible breast pockets of claim 14 wherein said upper body garment comprises a garment front opening in a front of said garment trunk, and said left pocket and said right pocket extend from said left pocket mouth and said right pocket mouth respectively substantially to said garment front opening.

18. A garment with underarm externally accessible breast pockets for wearing by a driver of a tandem-seating vehicle comprising an upper body garment comprising a left garment sleeve and a right garment sleeve depending from a garment trunk, a garment left side extending downwardly from an intersection of said garment left sleeve with said garment trunk, a garment right side extending downwardly from an intersection of said garment right sleeve with said garment trunk, a left pocket mouth disposed directly below said left garment sleeve, a right pocket mouth disposed directly below said right garment sleeve, a left pocket disposed within said upper body garment communicating with an exterior of said upper body garment through said left pocket mouth, a right pocket disposed within said upper body garment communicating with an exterior of said upper body garment through said right pocket mouth, the pocket mouths and the pockets being sized to admit a hand and arm of a tandem passenger rider sitting behind said driver, and non-slip material adhered to an inside of each said pocket, each said pocket being adhered to an inside of said garment trunk, whereby a passenger may grip said non-slip material for increased security.

19. The garment with underarm externally accessible breast pockets of claim 18 wherein said left pocket and said right pocket are adhered to an inside of said upper body garment, said left pocket is disposed at a pocket angle relative to said garment left side of 40 degrees±20 degrees, and said right pocket is disposed at a pocket angle relative to said garment right side of 40 degrees±20 degrees.

20. A garment with underarm externally accessible breast pockets for wearing by a driver of a tandem-seating vehicle comprising an upper body garment comprising a left garment sleeve and a right garment sleeve depending from a garment trunk, a garment left side extending downwardly from an intersection of said garment left sleeve with said garment trunk, a garment right side extending downwardly from an intersection of said garment right sleeve with said garment trunk, a left pocket mouth disposed directly below said left garment sleeve, a right pocket mouth disposed directly below said right garment sleeve, a left pocket disposed within said upper body garment communicating with an exterior of said upper body garment through said left pocket mouth, a right pocket disposed within said upper body garment communicating with an exterior of said upper body garment through said right pocket mouth, the pocket mouths and the pockets being sized to admit a hand and arm of a tandem passenger rider sitting behind said driver, said left pocket being attached to said upper body garment only at said left pocket mouth, and said right pocket being attached to said upper body garment only at said right pocket mouth, whereby the passenger's hands may move freely over a torso of said driver.

21. A method of wearing a garment with underarm externally accessible breast pockets that extend into the garment of a driver of a tandem-seating vehicle and wherein a tandem passenger rider sitting behind said driver places said passenger's hands therein comprising the steps of A. Providing an upper body garment having a left garment sleeve and a right garment sleeve extending from a garment trunk, a garment left side extending downwardly from an intersection of said left garment sleeve with said garment trunk, a garment right side extending downwardly from an intersection of said right garment sleeve with said garment trunk, a left pocket mouth disposed directly below said left garment sleeve, a right pocket mouth disposed directly below said right garment sleeve, a left pocket disposed within said upper body garment communicating with an exterior of said upper body garment through said left pocket mouth, a right pocket disposed within said upper body garment communicating with an exterior of said upper body garment through said right pocket mouth, said left pocket mouth, said right pocket mouth, said left pocket and said right pocket being sized to admit a passenger hand and arm;

B. Said tandem driver donning said upper body garment;

C. Positioning said tandem passenger behind said tandem driver;

D. Said tandem passenger inserting a passenger left arm and hand through said left pocket mouth into said left pocket; and E. Said tandem passenger inserting a passenger right arm and hand through said right pocket mouth into said right pocket.

22. The method of wearing a garment with underarm externally accessible breast pockets of claim 21 comprising the further steps of adhering the pockets to an inside of said garment trunk, providing a mitten shape termination comprising a thumb lobe and a major lobe for each said pocket, and said passenger gripping each said thumb lobe and said major lobe between passenger thumbs and passenger fingers.

23. The method of wearing a garment with underarm externally accessible breast pockets of claim 21 comprising the further steps of adhering the pockets to an inside of said garment trunk, providing a glove shape termination comprising a thumb lobe and a plurality of finger lobes for each said pocket, and said passenger gripping said thumb lobe and said finger lobes between passenger thumbs and passenger fingers.

24. The method of wearing a garment with underarm externally accessible breast pockets of claim 21 comprising the further steps of adhering the pockets to an inside of said garment trunk, providing non-slip material attached to an inside of each said pocket, and said passenger gripping said non-slip material for increased passenger security.

25. The method of wearing a garment with underarm externally accessible breast pockets of claim 21 comprising the further steps of adhering the pockets to an inside of said garment trunk at a pocket angle of substantially 90 degrees±20 degrees relative to respective garment sides, and channeling said passenger's hands through the pocket mouths, into the pockets, and directly said driver's breasts.

26. The method of wearing a garment with underarm externally accessible breast pockets of claim 21 comprising the further steps of adhering the pockets to an inside of said garment trunk at a pocket angle of substantially 40 degrees±20 degrees relative to respective garment sides, and channeling said passenger's hands through the pocket mouths, into the pockets, and away from said driver's breasts.

* * * * *